US009468797B1

(12) United States Patent
Miller

(10) Patent No.: US 9,468,797 B1
(45) Date of Patent: Oct. 18, 2016

(54) EXERCISE DEVICE WITH ELLIPTICAL STEPPING MOTION

(71) Applicant: Larry D. Miller, Rochester, MI (US)

(72) Inventor: Larry D. Miller, Rochester, MI (US)

(73) Assignee: Larry D. Miller Trust, Rochester, MI (US)

( * ) Notice: Subject to any disclaimer, the term of this patent is extended or adjusted under 35 U.S.C. 154(b) by 0 days.

(21) Appl. No.: 15/141,132

(22) Filed: Apr. 28, 2016

Related U.S. Application Data

(60) Provisional application No. 62/315,339, filed on Mar. 30, 2016.

(51) Int. Cl.
*A63B 22/00* (2006.01)
*A63B 22/04* (2006.01)
*A63B 23/035* (2006.01)

(52) U.S. Cl.
CPC ..... *A63B 22/04* (2013.01); *A63B 22/001* (2013.01); *A63B 23/03533* (2013.01)

(58) Field of Classification Search
USPC ..... 482/51–65
See application file for complete search history.

(56) References Cited

U.S. PATENT DOCUMENTS 3,316,898 A 5/1967 Brown et al.
5,653,662 A * 8/1997 Rodgers, Jr. ..... A63B 22/001 482/51
5,733,227 A 3/1998 Lee
5,788,610 A * 8/1998 Eschenbach ..... A63B 22/001 482/51
5,823,914 A 10/1998 Chen
5,957,814 A * 9/1999 Eschenbach ..... A63B 22/001 482/51
5,997,445 A 12/1999 Maresh et al.
6,168,552 B1 * 1/2001 Eschenbach ..... A63B 22/001 482/51
6,171,215 B1 * 1/2001 Stearns ..... A63B 22/001 482/51
6,196,948 B1 * 3/2001 Stearns ..... A63B 22/001 482/51
7,037,242 B2 5/2006 Lo et al.
7,104,929 B1 * 9/2006 Eschenbach ..... A63B 22/0015 482/52
7,137,927 B2 11/2006 Maresh et al.
7,153,239 B1 12/2006 Stearns et al.
7,169,090 B1 * 1/2007 Maresh ..... A63B 22/0007 482/51
7,172,531 B2 * 2/2007 Rodgers, Jr. ..... A63B 22/001 482/52
7,201,705 B2 * 4/2007 Rodgers, Jr. ..... A63B 22/001 482/52
7,214,168 B2 * 5/2007 Rodgers, Jr. ..... A63B 22/001 482/52
7,223,209 B2 * 5/2007 Lee ..... A63B 22/001 482/52
7,329,207 B1 2/2008 Maresh
7,344,480 B2 3/2008 Maresh et al.
7,361,122 B2 4/2008 Porth
7,513,854 B1 4/2009 Stearns et al.
8,210,993 B2 7/2012 Lee et al.

(Continued)

*Primary Examiner* — Stephen Crow
(74) *Attorney, Agent, or Firm* — Dinsmore & Shohl LLP; Douglas L. Wathen

(57) ABSTRACT

An exercise device includes a frame, pivotally connected arm links and a crank assembly. A pair of foot links each has a forward end, a rearward end, and a mid-portion. Each foot link has a crank attachment at the forward end that is connected the crank assembly. A foot receiving area is defined at the rearward end of each foot link. Each foot receiving area is longitudinally fixed with respect to the respective foot link and the mid portion of each foot link has a defined support location. The frame supports the support locations of the support links at a generally constant vertical height while allowing horizontal motion relative to the frame. The rearward length of the foot links is at least 1.5 times the forward length such that the foot receiving areas move in a path of travel having more vertical travel than horizontal travel.

20 Claims, 8 Drawing Sheets

(56) References Cited

U.S. PATENT DOCUMENTS

| | | | | |
|---|---|---|---|---|
| 8,668,627 | B2 * | 3/2014 | Eschenbach | A63B 21/00069 482/51 |
| 8,740,754 | B2 * | 6/2014 | Miller | A63B 22/001 482/51 |
| 8,795,139 | B2 | 8/2014 | Zhang et al. | |
| 8,974,352 | B2 * | 3/2015 | Eschenbach | A63B 22/0017 482/51 |
| 9,050,498 | B2 | 6/2015 | Lu et al. | |
| 9,067,094 | B2 | 6/2015 | Chang et al. | |
| 9,114,275 | B2 | 8/2015 | Lu et al. | |
| 9,138,614 | B2 | 9/2015 | Lu et al. | |
| 9,199,115 | B2 | 12/2015 | Yim et al. | |
| 2004/0043871 | A1 * | 3/2004 | Chang | A63B 22/001 482/52 |
| 2005/0101446 | A1 * | 5/2005 | Stearns | A63B 21/15 482/52 |
| 2007/0087907 | A1 * | 4/2007 | Rodgers | A63B 21/05 482/52 |
| 2007/0117683 | A1 | 5/2007 | Ercanbrack et al. | |
| 2007/0161464 | A1 | 7/2007 | Chiles et al. | |
| 2008/0139366 | A1 | 6/2008 | Born et al. | |
| 2008/0248928 | A1 | 10/2008 | Chu | |
| 2009/0093346 | A1 | 4/2009 | Nelson et al. | |
| 2010/0167879 | A1 | 7/2010 | Chu | |
| 2012/0004077 | A1 | 1/2012 | Chu | |
| 2012/0277066 | A1 * | 11/2012 | Hsu | A63B 22/001 482/57 |
| 2015/0182787 | A1 * | 7/2015 | Liu | A63B 22/001 482/52 |
| 2016/0059067 | A1 * | 3/2016 | Miller | A63B 21/154 482/52 |

* cited by examiner

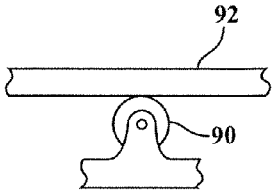
FIG. 5A
FIG. 5B
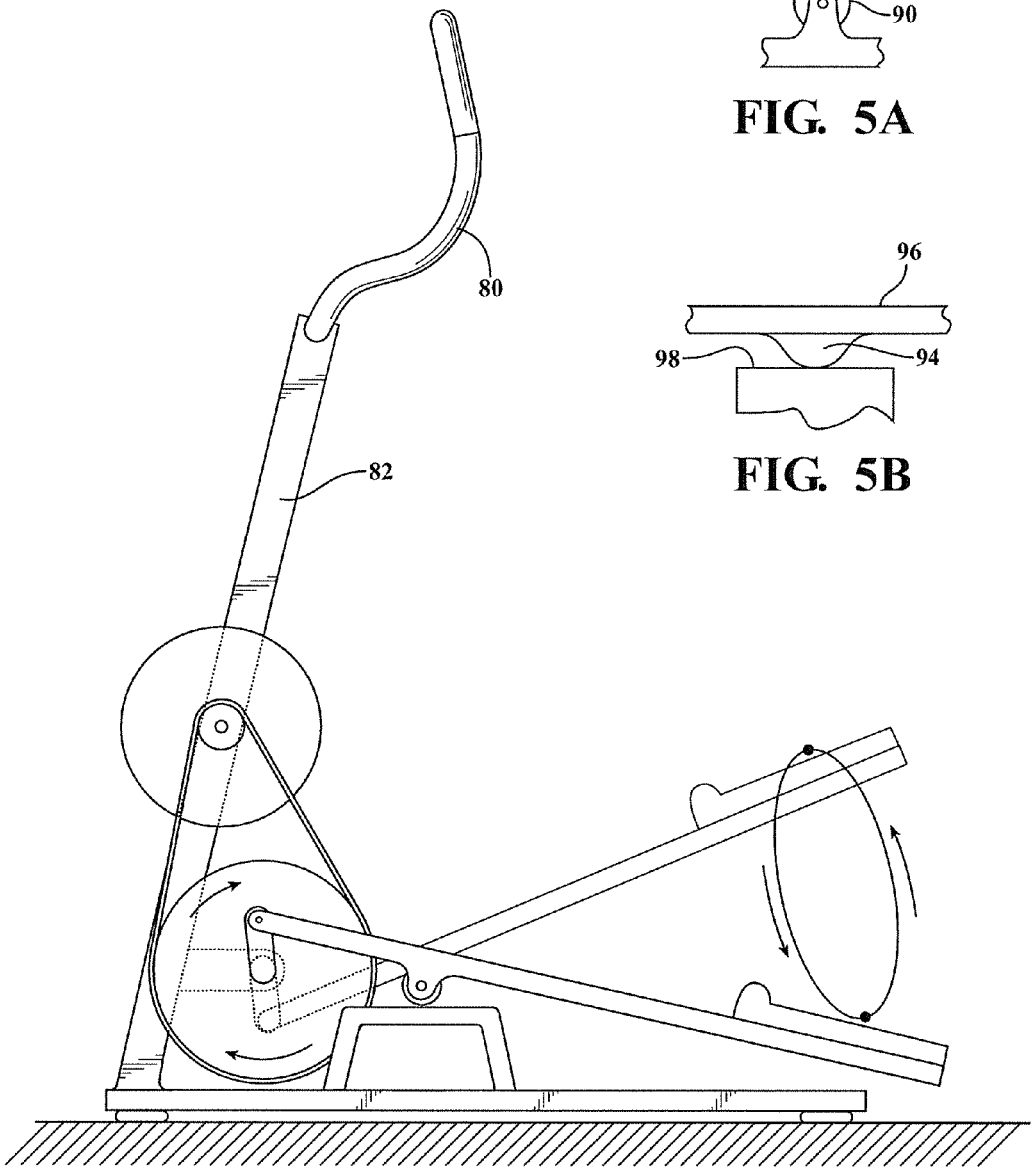
FIG. 4

EXERCISE DEVICE WITH ELLIPTICAL STEPPING MOTION

CROSS-REFERENCE TO RELATED APPLICATION

This application claims priority from U.S. provisional patent application Ser. No. 62/315,339, filed Mar. 30, 2016, the contents of which are incorporated herein in their entirety.

FIELD OF THE INVENTION

This invention relates generally to exercise devices which provide a stepping motion and, more specifically, to an exercise device that provides an elliptical stepping motion with vertical travel that is greater than horizontal travel.

BACKGROUND OF THE INVENTION

There are a number of exercise devices that operate to allow a user to implement a foot action simulating running, stair climbing and/or various other foot paths. Exercise devices where the path of travel is more vertical than horizontal are generally referred to as steppers or stair climbers. Exercise devices where the path of travel is more horizontal than vertical, and where the path forms a generally closed, curved path of travel, are generally referred to as elliptical exercise devices.

Typical steppers have foot receiving areas that reciprocate along the same, or nearly the same, path in both the up and down directions. There is a need for a stepper that provides a more complex path, wherein the foot receiving areas do not follow the same path in the up and down directions.

SUMMARY OF THE INVENTION

The present invention offers several embodiments of an exercise device that provides an elliptical stepping motion with vertical travel greater than horizontal travel. Some embodiments offer a path of motion with desirable characteristics. In addition, some embodiments are compact in form and have reduced mechanical complexity.

A first embodiment of an exercise device includes a frame configured to be supported on a horizontal surface. The frame has an arm pivot axis defined on an upper portion of the frame and a crank pivot axis defined on a lower portion. A pair of arm links is pivotally connected to the arm pivot axis. A crank assembly is pivotally connected to the crank pivot axis for rotation about the crank pivot axis, the crank assembly having a first and a second attachment point each offset from the crank pivot axis and separated from each other by approximately 180 degrees. A pair of foot links each has a forward end, a rearward end, and a mid-portion therebetween. Each foot link has a crank attachment at the forward end, the crank attachment connected to one of the attachment points of the crank assembly such that the crank attachments move in a circular path as the crank assembly rotates. A foot receiving area is defined at the rearward end of each foot link. Each foot receiving area is longitudinally fixed with respect to the respective foot link and the mid portion of each foot link has a defined support location. The frame further has a foot link support that vertically supports the support locations of the support links at a generally constant vertical height while allowing horizontal motion of the foot links relative to the frame. Each foot link has a forward length defined from the support location to the crank attachment and a rearward length defined from the support location to a central point of the foot receiving area. The rearward length of the foot links being at least 1.5 times the forward length such that as the crank assembly rotates, the foot receiving areas move in a path of travel having more vertical travel than horizontal travel. A pair of arm drive links each have an upper end connected to one of the arm links and a lower end connected to one of the foot links or the crank assembly such that each arm link moves out of phase with the respective foot receiving area.

In certain embodiments, each foot link has a roller at the support location and the foot link support of the frame comprises a foot support surface disposed such that the rollers are disposed on the foot support surface, thereby vertically supporting the foot links.

In some versions, the foot support surface is generally horizontal and is selected from the group consisting of flat, concave and convex.

In some versions, the foot support surface comprises two surfaces each supporting one of the rollers.

In some versions, the foot links are supported only by the foot support surface and the crank assembly.

In some versions, the foot support surface is adjustable.

In certain embodiments, the foot link support of the frame comprises a pair of foot support links each having an upper end pivotally connected to the frame and a lower end pivotally connected to the support location of one of the foot links, thereby vertically supporting the foot links.

In some versions, the foot support links each extend generally vertically when the respective foot receiving area is at a highest or lowest position In some versions, the upper end of each foot support link is pivotally connected to the frame at or near the arm pivot axis.

In some versions, the upper end of each foot support link is pivotally connected to a mid portion of the frame that is generally between the upper and lower portions of the frame.

In some versions, the support location of each of the foot links is adjustable such that the range of vertical travel is adjustable.

In some versions, the foot links are supported only by the foot support links and the crank assembly.

In some versions, each of the foot receiving areas move in a generally elliptical path having a major axis, the major axis being inclined with respect to horizontal by 40 degrees or more.

In some versions, each of the foot receiving areas move in a curved closed path having a major axis, the major axis being inclined with respect to horizontal by 40 degrees or more.

In some versions, the forward and/or rearward length of each of the foot links is adjustable so as to adjust the range of vertical travel.

In some versions, the foot links are each elongated generally straight members.

In some versions, the foot links are each generally horizontal when the respective foot receiving area is at a mid point of vertical travel.

In some versions, the crank assembly further comprises a flywheel and/or resistance mechanism.

In some versions, the exercise device further includes a pair of foot platforms each defining one of the foot receiving areas, the foot platforms being pivotally interconnected with the rearward end the foot links.

In some versions, the rearward length of each foot link is at least twice the forward length.

A second embodiment of an exercise device includes a frame configured to be supported on a horizontal surface. The frame has a crank pivot axis defined on a lower portion. A pair of arms are connected to the frame. A crank assembly is pivotally connected to the crank pivot axis for rotation about the crank pivot axis, the crank assembly having a first and a second attachment point each offset from the crank pivot axis and separated from each other by approximately 180 degrees. A pair of foot links each has a forward end, a rearward end, and a mid-portion therebetween. Each foot link has a crank attachment at the forward end, the crank attachment connected to one of the attachment points of the crank assembly such that the crank attachments move in a circular path as the crank assembly rotates. A foot receiving area is defined at the rearward end of each foot link. Each foot receiving area is longitudinally fixed with respect to the respective foot link and the mid portion of each foot link has a defined support location. The frame further has a foot link support that vertically supports the support locations of the support links at a generally constant vertical height while allowing horizontal motion of the foot links relative to the frame. Each foot link has a forward length defined from the support location to the crank attachment and a rearward length defined from the support location to a central point of the foot receiving area. The rearward length of the foot links being at least 1.5 times the forward length such that as the crank assembly rotates, the foot receiving areas move in a path of travel having more vertical travel than horizontal travel.

BRIEF DESCRIPTION OF THE DRAWINGS

FIG. 4 is a side elevational view of another embodiment of an exercise device in accordance with the present invention;

FIG. 5A is a detailed view of a portion of an exercise device, showing an alternative roller arrangement;

FIG. 5B is a detailed view of a portion of an exercise device, showing a sliding arrangement that is an alternative to the roller arrangement in other embodiments;

DETAILED DESCRIPTION OF THE PREFERRED EMBODIMENTS

The present invention will be explained with reference to several particular embodiments, including variations and optional features of these embodiments. It is to be understood that yet other embodiments, modifications, and variations thereof will be apparent to those of skill in the art in view of the teaching presented herein. Further, features and elements of certain embodiments may be combined with each other in combinations other than those illustrated, and variations and optional features may be used with any of the embodiments.

The present invention relates to exercise devices which are often referred to as steppers or stair climbers, but the illustrated embodiments differ from typical steppers in that they provide an elliptical stepping motion. Certain embodiments are illustrated with adjustment arrangements for adjusting the range of vertical travel of the foot receiving areas and/or the range of the arm motion. Such adjustment arrangements may be used with embodiments other than those on which they are illustrated.

An exercise device according to the present invention is designed to be used by a user placing their feet on respective foot receiving areas and then moving their feet along a generally stepping path. The right and left foot receiving areas are 180 degrees out of phase such that as one area is moving upwardly, the other is moving downwardly. The foot paths will have horizontal and vertical components, with the vertical component being greater than the horizontal component. The term "elliptical" is used herein to mean any closed curved path, whether or not the path is an actual ellipse.

Figure 1:
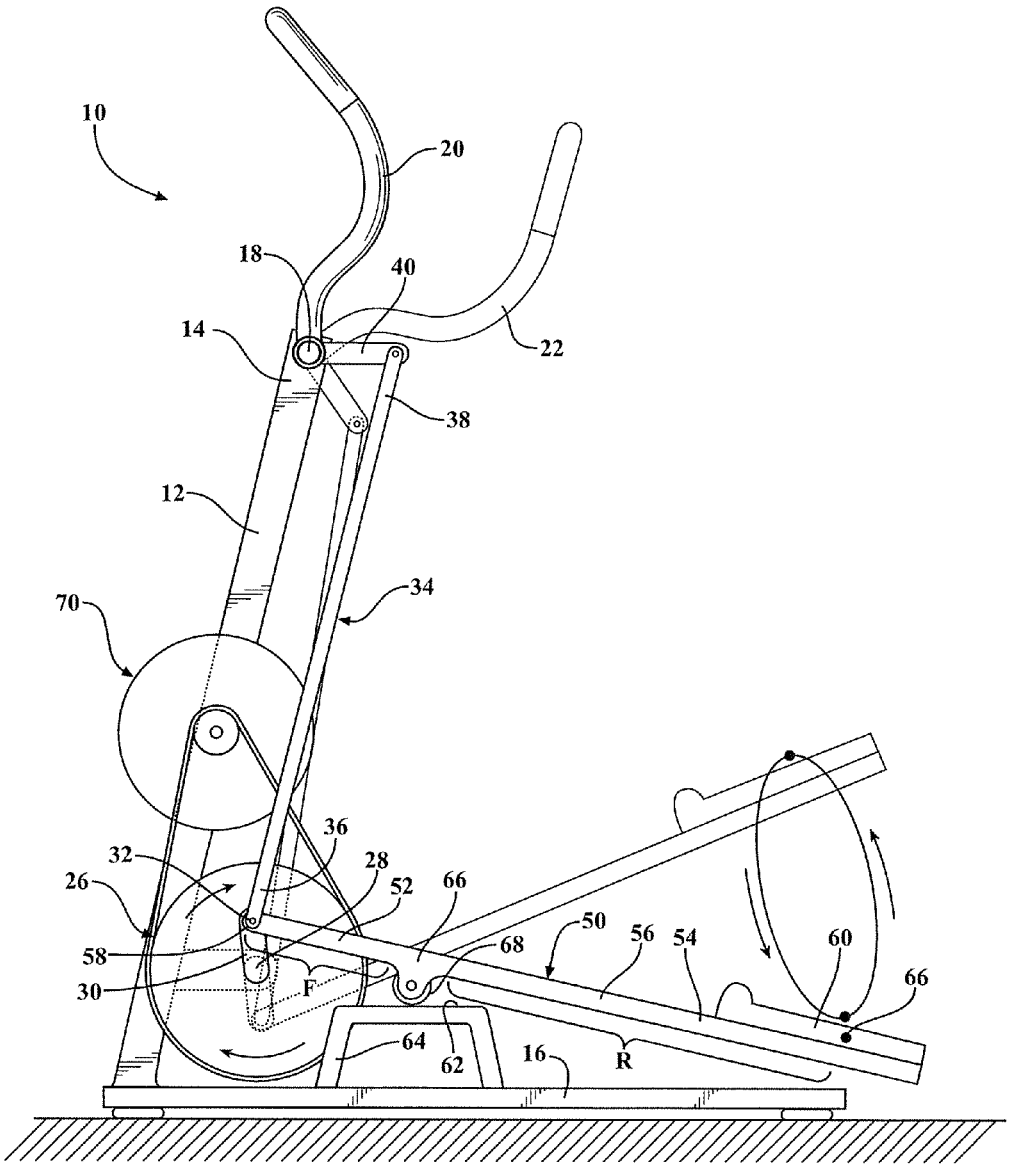
FIG. 1 is a side elevational view of an embodiment of an exercise device in accordance with the present invention.

FIG. 1 provides a side elevational view of a first embodiment of an exercise device 10 structured in accord with the principles of the present invention. The device includes a frame 12 which is configured and operative to retain and support the various other components of the device on a horizontal surface such as a floor. The frame may be said to have an upper portion 14 and a lower portion 16, with the lower portion configured to contact the horizontal surface while the upper portion supports various components of the device 10. The frame 12 is typically fabricated from metal and/or composite materials, but any material may be used. An arm pivot axis 18 is defined in the upper portion 14 of the frame 12.

A pair of arm links is pivotally interconnected with the frame so as to be pivotable about the arm pivot axis 18. A left or first arm link 20 is shown at its forwardmost point of travel. A right or second arm link 22 is shown at its rearwardmost point of travel. All left and right components may alternatively be referred to as first and second components for ease of description. The embodiments of the present invention will be described primarily with respect to the left set of components with it being understood that the right set of components are equivalent though typically out of phase with the left.

A crank assembly 26 is pivotally connected to a crank pivot axis 28 on the lower portion 16 of the frame 12. The crank assembly has a pair of crank arms, with the first crank arm shown at 30. An outer end of the first crank arm 30 defines a first crank arm attachment point 32 that is offset from the crank pivot axis 28.

A first arm drive link 34 has a lower end 36 connected to the first crank arm attachment point 32 and an upper end 38 connected to an extension 40 of the first arm link 20. The extension 40 extends rearwardly from the arm pivot axis 18. As will be clear to those of skill in the art, as the crank assembly 26 rotates about the crank pivot axis 28, the crank drive arm 34 causes the first arm link 20 to pivot back and forth about the arm pivot axis 18 thereby exercising the user's arm. The second arm link 22 is driven by a second arm drive link that is connected to the other crank arm of the crank assembly, such that the arm links are out of phase.

A pair of foot links are provided. A first foot link 50 has a forward end 52, a rearward end 54 and a midportion 56 defined therebetween. The foot link 50 has a crank attachment 58 at the forward end. This crank attachment 58 is connected to the attachment point 32 on the first crank arm 30 such that as the crank assembly rotates, the crank attachment 58 of the foot link 50 moves in a circular path. The foot link 50 further has a foot receiving area 60 defined at the rearward end 54 of the link. It is noted that the foot receiving areas are longitudinally fixed with respect to the respective foot links. In other words, the foot receiving areas do not slide or otherwise move along the length of their respective foot link. Each foot receiving area may be said to have a central point defined half way along the length of the area designed to receive the foot. As shown, each foot receiving area is a foot-sized region at the rearward end of the respective foot link. The central point is the longitudinal midpoint of the area designated to receive the foot and is typically about in the middle of where a user will naturally position their foot.

Each foot link further has a support location defined in the mid portion. The frame of the exercise device vertically supports these support locations at a generally constant vertical height while allowing horizontal motion of the foot links relative to the frame. The vertical support may take various forms. In FIG. 1, the lower portion 16 of the frame includes a foot support surface 62. In this embodiment, a foot support structure 64 extends upwardly from the base of the frame and the foot support surface is the upper surface 62 of the structure 64. The foot support link 50 has a support location 66 in the mid portion 56 and the support location has a roller 68 extending from a lower surface of the foot support link 50. The roller 68 engages the foot support surface 62 thereby vertically supporting the support location 66. At the same time, the foot support link 50 is free to move horizontally, fore and aft, by the roller 68 rolling along the surface 62. In this embodiment, the surface 62 is generally flat in the longitudinal direction and generally horizontal. The support structure 64 may provide a support surface for both foot support links or two separate surfaces may be provided. The surfaces may be flat side to side or may be shaped like a channel or guide.

As will be clear to those of skill in the art, as the crank assembly 26 rotates, the attachment points of the foot support links move in a circular path causing the foot receiving areas at the rearward end of the foot support links to move in an elliptical path. As shown, the forward portion of each foot support link, forward of the roller, is much shorter than the rearward portion, behind the roller. This causes the foot path to have more vertical travel than horizontal travel. Each foot support link may be said to have a forward length F defined as distance between the support location 66 and the crank attachment 58 and a rearward length R defined as the distance between the support location 66 and the central point 66 of the foot receiving area. The support location may be defined as the longitudinal position where the vertical support is provided, which would be the rotational axis of the roller 68 in this embodiment. It is preferred that the rearward length R be at least one and one-half times (1.5 times) the forward length F. In some versions, the rearward length R is at least twice the forward length F.

As will be clear from FIG. 1, each arm link is out of phase with the respective foot receiving area, such that when the foot receiving area is at its lowest point, the hand grip of the arm link is at its highest or forwardmost position and when the foot receiving area is at its highest point, the corresponding arm link is at its lowest or rearmost position. This arm/foot phasing is preferred.

The device 10 also includes a flywheel and/or resistance assembly 70 that is connected to the crank assembly 26 by a belt. Alternatively, a flywheel and/or resistance assembly may be integrated into the crank assembly. It is noted that while the crank assembly 26 is shown as having crank arms defining the attachments, the offset attachments may be provided in other ways, such as providing attachments on a disk or wheel.

Figure 2:
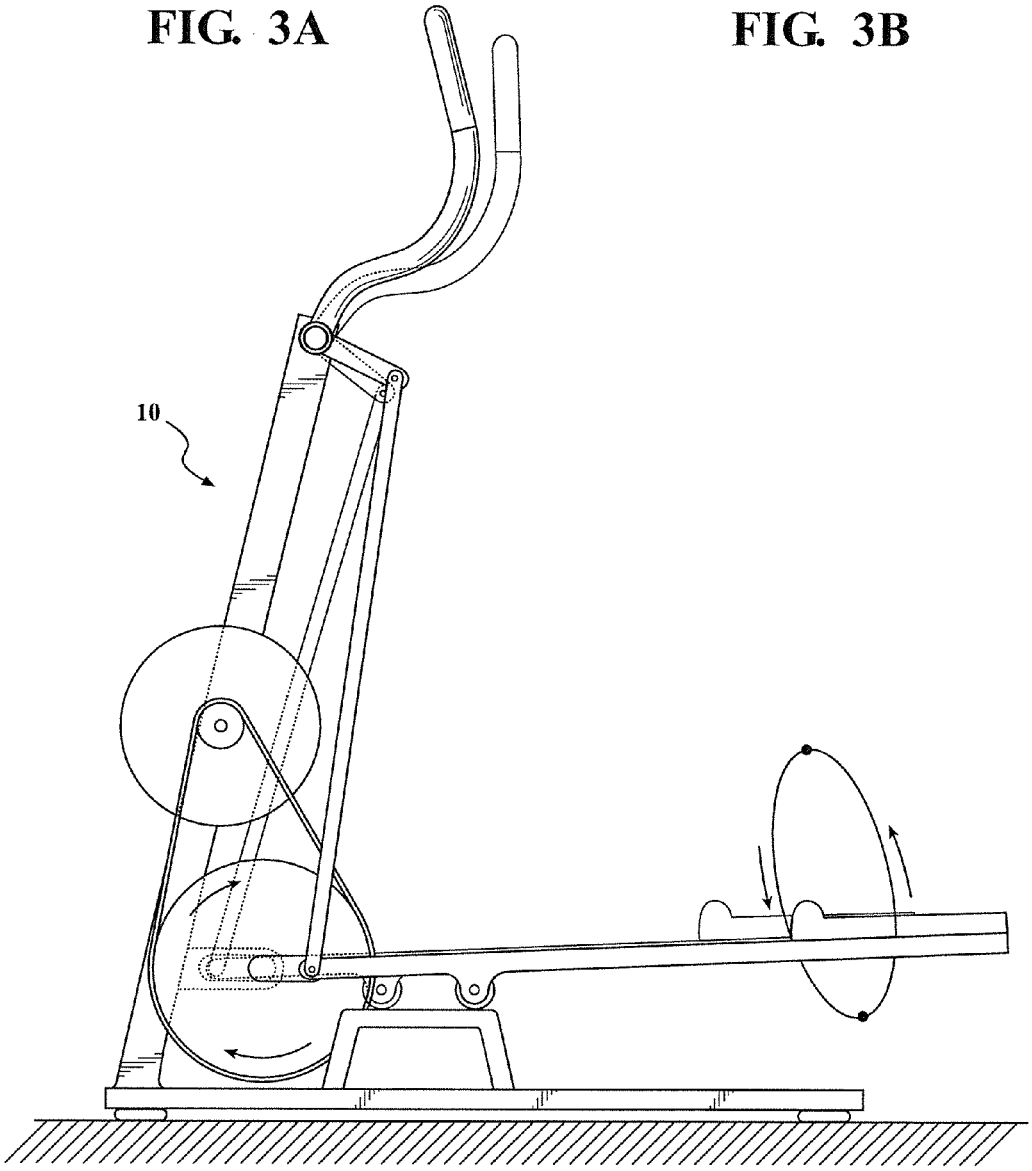
FIG. 2 is a side elevation view of the embodiment of FIG. 1 with the crank assembly rotated 90 degrees.

FIG. 2 shows the device 10 of FIG. 1 with the crank assembly rotated 90 degrees, such that the foot receiving areas are both at a midpoint of their vertical travel.

Figure 3A:
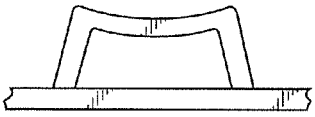
FIG. 3A is a detailed view of a portion of an exercise device, showing an alternative foot support surface.
Figure 3B:
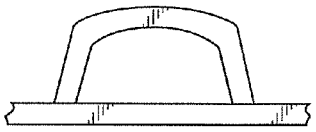
FIG. 3B is a detailed view of a portion of an exercise device, showing another alternative foot support surface.

FIGS. 3A and 3B shown alternative foot support surface profiles. FIG. 3A shows a surface that is concave and FIG. 3B shows a surface that is convex. In each case, the surfaces are generally horizontal, despite being curved.

FIG. 4 shows an alternative embodiment of an exercise device in which the arm links 80 are fixed to the frame 82. The remainder of the device is the same as in FIG. 1.

FIG. 5A shows an alternative foot link support in which a roller 90 is provided on the lower portion of the frame and the foot link 92 rolls on the roller 90. This arrangement may be used with any embodiment, but is not preferred, since the effective lever ratio of the foot link changes as the crank assembly rotates. That is, the forward and rearward lengths change. It is preferred that if this arrangement is used, the rearward length is at least 1.5 times the forward length at all crank positions. Alternatively, it is preferred that the rearward length is at least 1.5 times the forward length at a midpoint of horizontal travel of the foot receiving areas.

FIG. 5B shows another alternative foot link support in which the roller is replaced by a sliding arrangement. A sliding element 94 is provided on the underside of the foot link 96. The sliding element 94 slides on the foot support surface 98. The sliding element and surface may be reversed such that the sliding element is fixed and the foot link slides on it, but this is not preferred. The sliding element may take any form known to those of skill in the art, such as being formed of a low friction polymer. The surface 98 may be flat or curved and may have a groove or other shape for guiding the sliding element.

Figure 6:
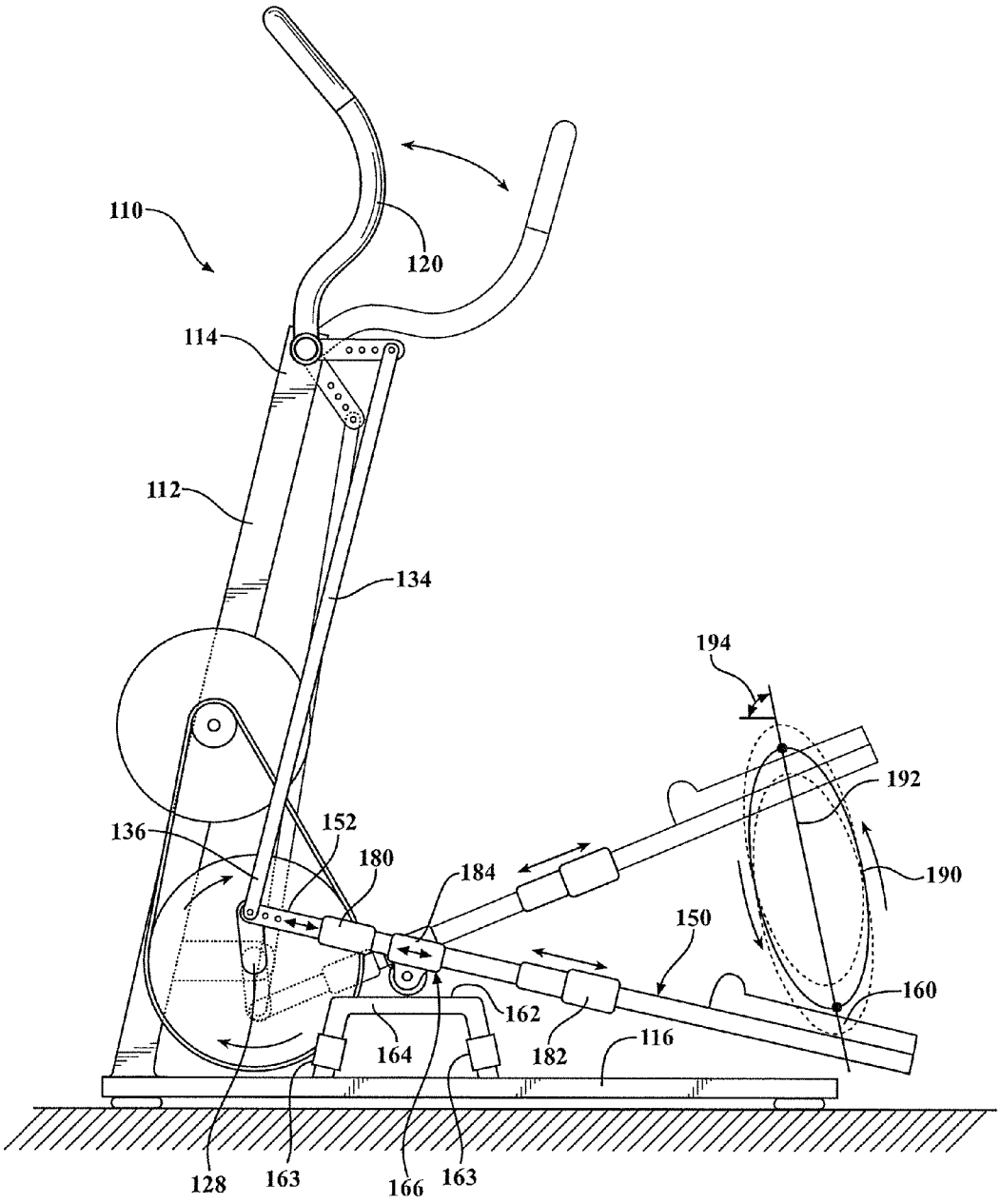
FIG. 6 is a side elevational view of a further embodiment of an exercise device showing several approaches to adjusting foot and arm travel.

FIG. 6 provides a side elevational view of another embodiment of an exercise device 110 that is very similar to the device 10 of FIGS. 1 and 2. The device 110 differs in that various adjustment arrangements are illustrated. These adjustment arrangements represent various optional arrangements and would typically not all be used in one device. In order to adjust the travel of the arm link 120, the attachment locations for the arm drive link 134 may be adjusted. For example, alternative attachment points are shown on the extension 140 of the arm link 120. By moving the attachment closer to the pivot 118, arm travel is increased, and vice versa. Alternative attachment points are also shown on the forward end 152 of the foot link 150 and the lower end 136 of the arm drive link 134 may be attached to the foot link instead of the crank arm. The attachment points may be adjusted by manually moving the link to different attachments or by providing a sliding collar that is manually adjusted or power actuated.

The range of vertical travel of the foot receiving area 160 may also be adjusted in various ways. Each approach changes the forward or rearward length of the foot link. An adjuster 180 is schematically represented on the forward portion of the foot link 150. It is operative to adjust the length of the forward portion. An alternative adjuster 182 is shown on the rear portion of the foot link and is operative to adjust the length of the forward portion. A further alternative adjuster 184 is shown at the support location and is operative to change the location of the roller on the foot link, thereby adjusting the relative lengths of the forward and rear portions. The alternative foot travel adjusters may be manually or power adjusted. Any of these adjusters can be used with any embodiment of the present invention, in any combination.

FIG. 6 also illustrates various generally elliptical paths of travel 190. As the relative lengths of the forward and rearward portions of the foot links 150 are adjusted, the height of the elliptical path of travel 190 increases or decreases, as indicated by the dashed and solid lines. The path of travel 190 is generally ellipsoidal and may be said to have a major axis 192. As shown, the angle 194 of the major axis 192 remains generally constant independent of the vertical travel. It is preferred that the major axis is inclined with respect to horizontal by 40 or more degrees. In the illustrated embodiment, the major axis 192 is inclined at a substantially greater angle. As will be clear to those of skill in the art, some embodiments may have a path of travel that is less elliptical. For example, versions using the roller on the frame, as in FIG. 5A, will have a path of travel that is less ellipsoidal. Nonetheless, such a path will be a closed curved path having a major axis bisecting the area of the curved path in the long direction. As with the more elliptical path of FIG. 6, it is preferred that the major axis of a less elliptical path be inclined with respect to horizontal by 40 or more degrees.

As will be clear to those of skill in the art, the angle of the major axis may be adjusted by altering the relative heights of the crank axis 128 and the support location 166. In the illustrated embodiments, the heights are similar. FIG. 6 illustrates one approach to adjusting the relative heights, though other approaches may be used. Adjusters are 163 are provided for adjusting the height and/or angle of the foot support structure 164, and thereby adjust the height and/or angle of the foot support surface 162. By raising the foot support structure, the angle of the major axis relative to horizontal, indicated at 194, will be decreased.

Figure 7:
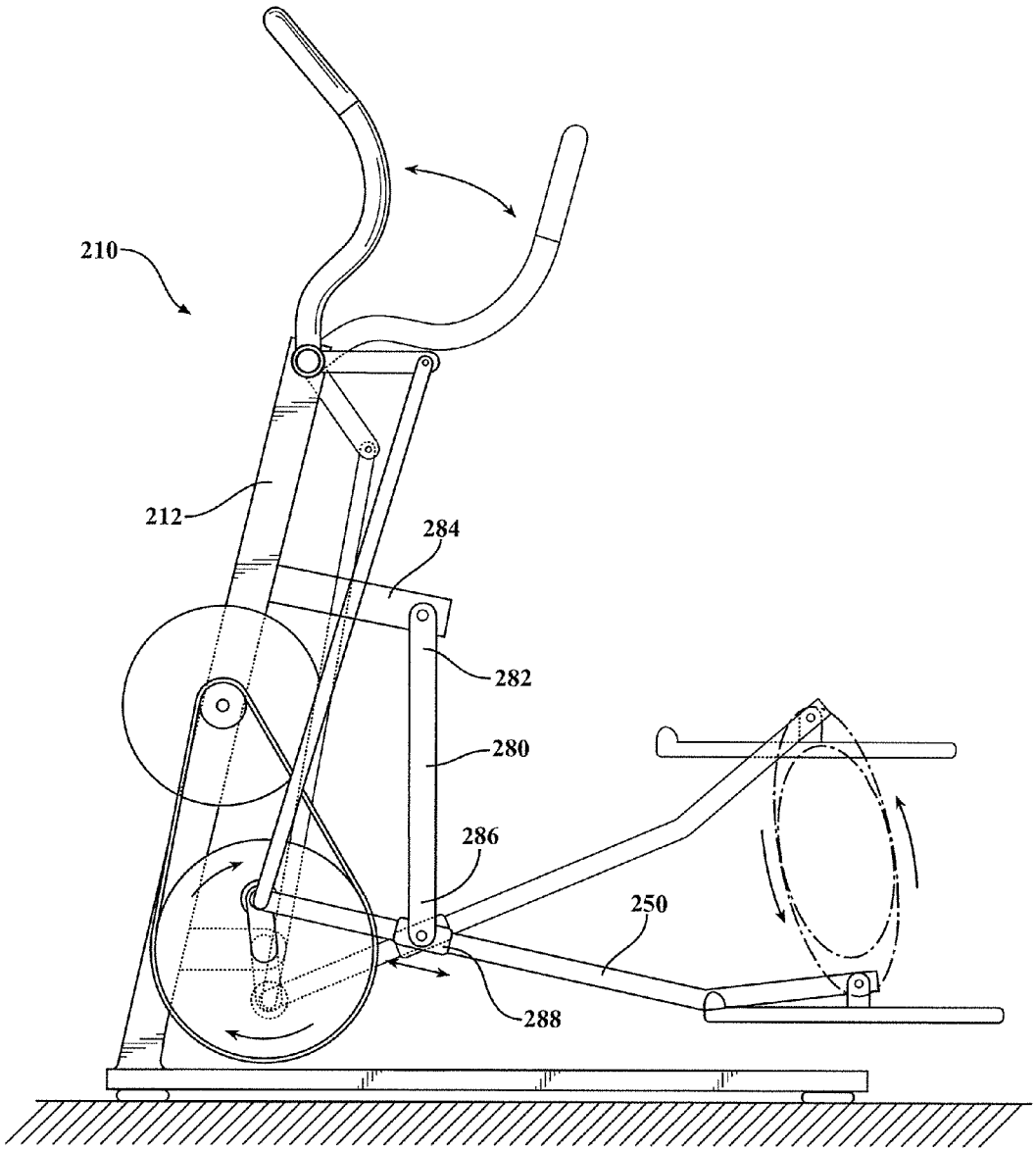
FIG. 7 is a side elevational view of yet another embodiment of an exercise device in accordance with the present invention.

FIG. 7 provides a side elevational view of another embodiment of an exercise device 210 structured in accord with the principles of the present invention. The device is similar to previous embodiments in certain respects. Only the differences will be described. In this embodiment, the foot link support takes the form of foot support links. Foot support link 280 has an upper end 282 pivotally connected to an extension 284 of the frame 212 and a lower end 286 pivotally connected to a support location 288 of the foot support link 250. The foot support links vertically support the support locations of the foot links at a generally constant vertical height while allowing horizontal movement of the foot links. As the foot support link 280 swings fore and aft, the vertical position of the lower end will change slightly, but this is considered to be a generally constant vertical height for purposes of this invention. The support location 288 on the foot support link 250 may be a fixed location or may be adjustable using a collar, as shown, or other approaches. The alternative adjustment approaches discussed earlier may also be used. The embodiment of FIG. 7 also differs in that the foot receiving areas are pivotally interconnected with the foot links. This alternative may be used with any embodiment and allows the user's feet to remain closer to remain more horizontal.

Figure 8:
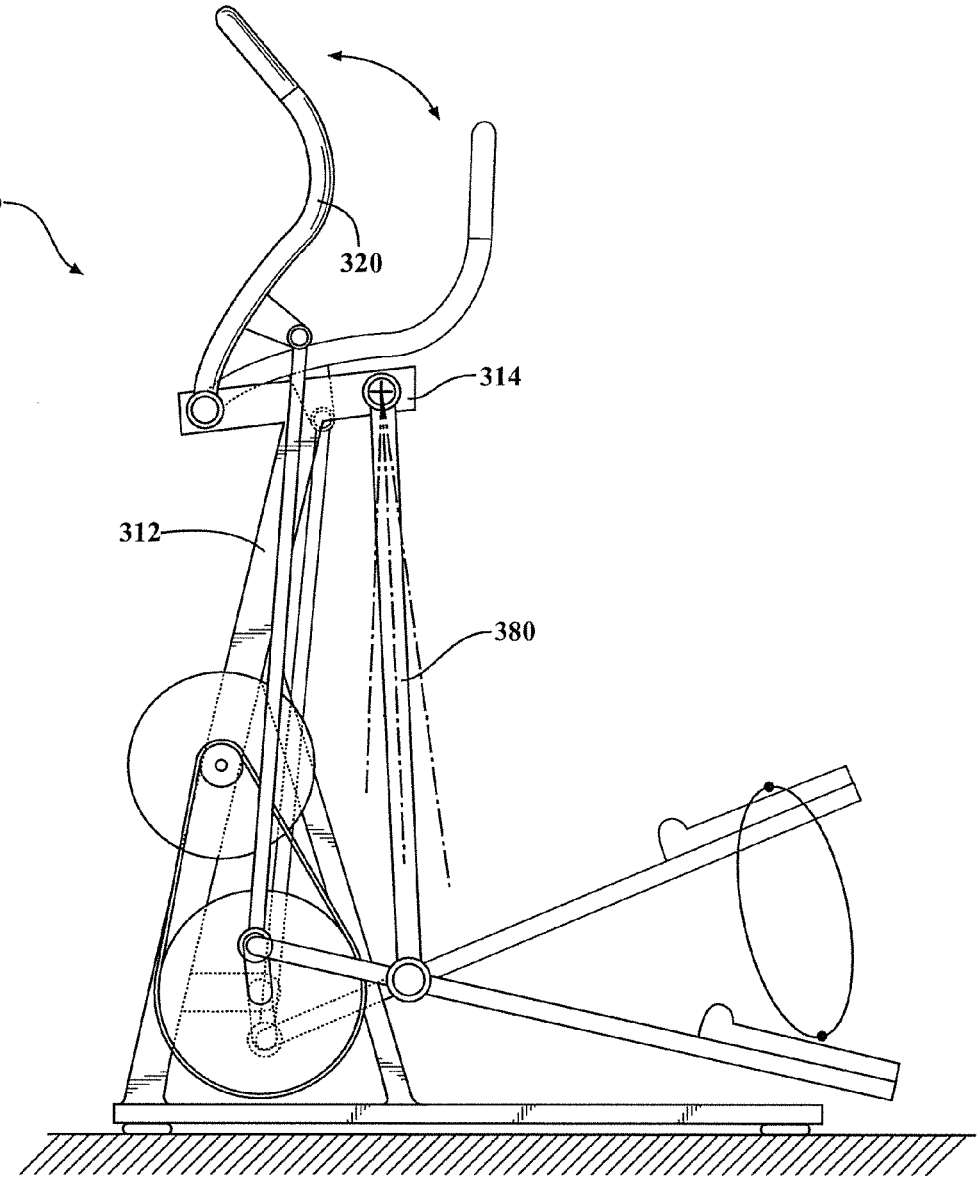
FIG. 8 is a side elevational view of an alternative embodiment of an exercise device in accordance with the present invention.

FIG. 8 illustrates a device 310 that is similar to the device of FIG. 7 except that the foot support link 380 is longer and attaches to the upper portion 314 of the frame 312. In this embodiment the arm link 320 is pivoted to the frame 312 at a location forward of the attachment point for the foot support link 380 but at approximately the same height.

Figure 9:
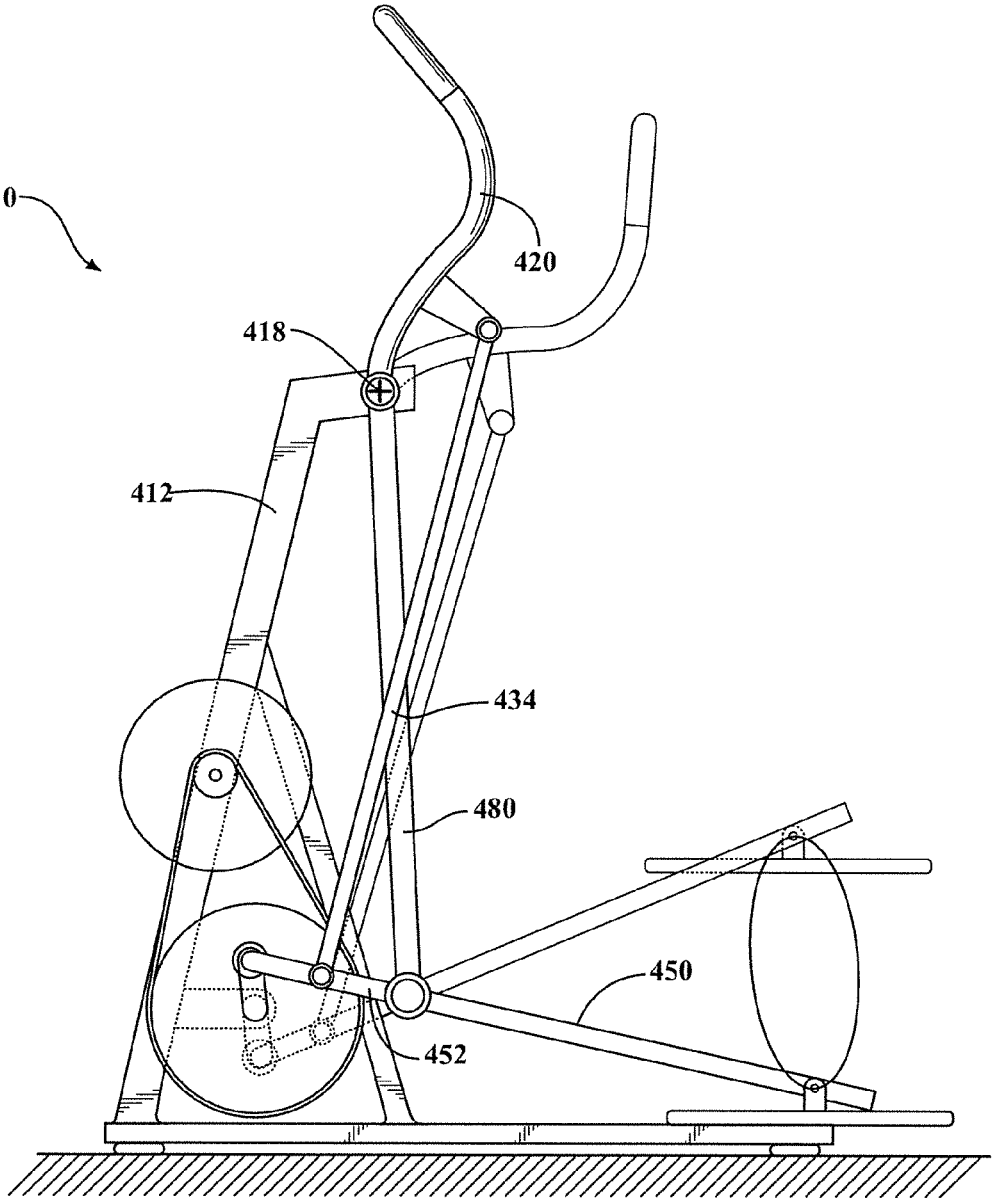
FIG. 9 is a side elevational view of another alternative embodiment of an exercise device in accordance with the present invention.

FIG. 9 illustrates a device 410 that is similar to the device of FIG. 8 except that the foot support link 480 is pivoted to the frame 412 at the same pivot axis 418 as the arm link 420. However, the arm link 420 and foot support link are movable independently; they only share the pivot location. The device 410 also differs in that the arm drive link 434 is pivotally attached to the forward end 452 of the foot link 450 instead of to the crank. Finally, the device 410 also has the foot receiving areas link FIG. 7.

Figure 10:
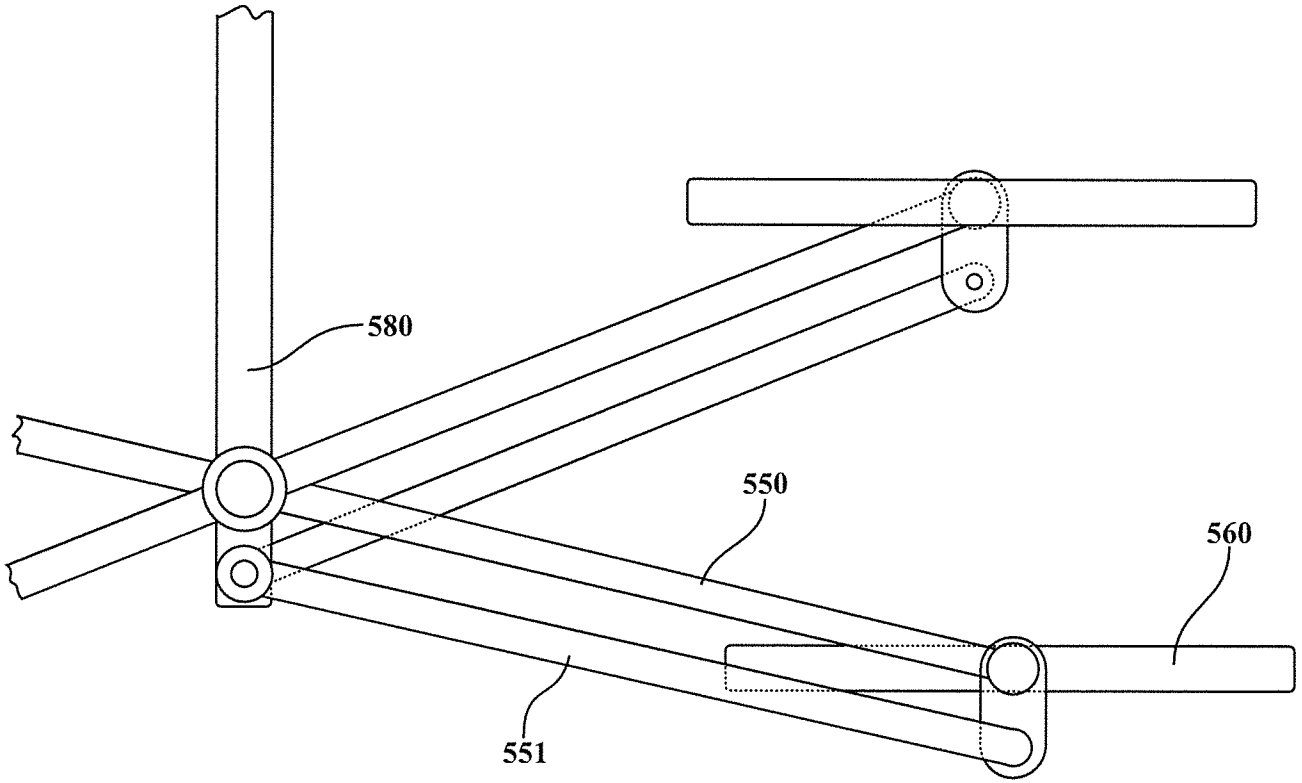
FIG. 10 is a detailed view showing an alternative approach to providing foot receiving areas for any embodiment.

FIG. 10 is a detailed view showing an alternative structure for the foot links, providing a four bar linkage that maintains the foot receiving areas in a horizontal position. A foot link is shown at 550 pivotally attached to a foot support link 580. A foot alignment link 551 is parallel to the foot link 550 and has a forward end pivoted to the foot support link. The foot receiving area 560 is pivoted to both the foot link 550 and foot alignment link 551 such that the foot receiving area 560 remains generally horizontal as the foot link 550 moves. This arrangement, or a similar arrangement, may be used with any embodiment herein to provide a horizontal foot receiving area.

For definitional purposes, the exercise devices and the frames thereof may be said to have a forward portion that is forward of the support location of the foot links when these links are at the midpoint of their horizontal travel. As shown, the crank assembly is disposed on this forward portion. It is noted that the crank axis is at a fixed location on the frame.

The foregoing describes some particular embodiments of the present invention. Other embodiments, modifications, and variations thereof will be apparent to those of skill in the art in view of the teaching presented herein. The foregoing is not meant to be a limitation upon the practice of the present invention. For example, any feature of any of the embodiments disclosed herein may be used with any other feature or embodiment disclosed herein. It is the following claims, including all equivalents, which define the scope of the invention.

The invention claimed is:

1. An exercise device for providing an elliptical stepping motion with vertical travel greater than horizontal travel, the exercise device comprising:

a frame having a lower portion configured to be supported on a horizontal surface, the frame having an arm pivot axis defined on an upper portion of the frame and a crank pivot axis defined on the lower portion;

a pair of arm links pivotally connected to the arm pivot axis;

a crank assembly pivotally connected to the crank pivot axis for rotation about the crank pivot axis, the crank assembly having a first and a second attachment point each offset from the crank pivot axis and separated from each other by approximately 180 degrees;

a pair of foot links each having a forward end, a rearward end, and a mid-portion therebetween, each foot link having a crank attachment at the forward end, the crank attachment connected to one of the attachment points of the crank assembly such that the forward ends of the foot links move in a circular path as the crank assembly rotates, a foot receiving area defined at the rearward end of each foot link, each foot receiving area being longitudinally fixed with respect to the respective foot link, the mid portion of each foot link having a defined support location;

the frame further having a foot link support that vertically supports the support locations of the support links at a generally constant vertical height while allowing horizontal motion of the foot links relative to the frame;

each foot link having a forward length defined from the support location to the crank attachment and a rearward length defined from the support location to a central point of the foot receiving area, the rearward length of the foot links being at least 1.5 times the forward length such that as the crank assembly rotates, the foot receiving areas move in a path of travel having more vertical travel than horizontal travel; and a pair of arm drive links each having an upper end connected to one of the arm links and a lower end connected to one of the foot links or the crank assembly such that each arm link moves out of phase with the respective foot receiving area.

2. An exercise device according to claim 1, wherein each foot link has a roller at the support location and the foot link support of the frame comprises a foot support surface disposed such that the rollers are disposed on the foot support surface, thereby vertically supporting the foot links.

3. An exercise device according to claim 2, wherein the foot support surface is generally horizontal and is selected from the group consisting of flat, concave and convex.

4. An exercise device according to claim 2, wherein the foot support surface comprises two surfaces each supporting one of the rollers.

5. An exercise device according to claim 2, wherein the foot links are supported only by the foot support surface and the crank assembly.

6. An exercise device according to claim 2, wherein the foot support surface is adjustable.

7. An exercise device according to claim 1, wherein the foot link support of the frame comprises a pair of foot support links each having an upper end pivotally connected to the frame and a lower end pivotally connected to the support location of one of the foot links, thereby vertically supporting the foot links.

8. An exercise device according to claim 7, wherein the foot support links each extend generally vertically when the respective foot receiving area is at a highest or lowest position.

9. An exercise device according to claim 7, wherein the upper end of each foot support link is pivotally connected to the frame at or near the arm pivot axis.

10. An exercise device according to claim 7, wherein the upper end of each foot support link is pivotally connected to a mid portion of the frame that is generally between the upper and lower portions of the frame.

11. An exercise device according to claim 7, wherein the support location of each of the foot links is adjustable such that the range of vertical travel is adjustable.

12. An exercise device according to claim 7, wherein the foot links are supported only by the foot support links and the crank assembly.

13. An exercise device according to claim 1, wherein each of the foot receiving areas move in a generally elliptical path having a major axis, the major axis being inclined with respect to horizontal by 40 degrees or more.

14. An exercise device according to claim 1, wherein each of the foot receiving areas move in a curved closed path having a major axis, the major axis being inclined with respect to horizontal by 40 degrees or more.

15. An exercise device according to claim 1, wherein the forward and/or rearward length of each of the foot links is adjustable so as to adjust the range of vertical travel.

16. An exercise device according to claim 1, wherein the foot links are each elongated generally straight members.

17. An exercise device according to claim 1, wherein the foot links are each generally horizontal when the respective foot receiving area is at a mid point of vertical travel.

18. An exercise device according to claim 1, wherein the crank assembly further comprises a flywheel and/or resistance mechanism.

19. An exercise device according to claim 1, further comprising a pair of foot platforms each defining one of the foot receiving areas, the foot platforms being pivotally interconnected with the rearward end the foot links.

20. An exercise device according to claim 1, wherein the rearward length of each foot link is at least twice the forward length.

* * * * *